United States Patent [19]

Ries et al.

[11] Patent Number: 4,899,264

[45] Date of Patent: Feb. 6, 1990

[54] DRYER DRUM LAMP ASSEMBLY

[75] Inventors: Stuart W. Ries, St. Joseph Township, Berrien County; Irene M. Shembarger, Berrien Township, Berrien County, both of Mich.

[73] Assignee: Whirlpool Corporation, Benton Harbor, Mich.

[21] Appl. No.: 381,575

[22] Filed: Jul. 18, 1989

[51] Int. Cl.[4] ..... F21V 33/00

[52] U.S. Cl. ..... 362/92; 362/89; 362/94; 362/253; 362/370; 34/88

[58] Field of Search ..... 362/89, 92, 94, 253, 362/370, 371, 427; 34/88, 133

[56] References Cited

U.S. PATENT DOCUMENTS 1,126,454 1/1915 Hamm .
1,757,346 5/1930 Taussig .
2,313,506 3/1943 Berg ..... 362/94
2,403,904 7/1946 Blomberg .
2,587,371 2/1952 Nettesheim .
2,752,694 7/1956 McCormick .
2,814,130 11/1957 Cayot .
2,816,216 12/1957 Dasher .

*Primary Examiner*—Allen M. Ostrager
*Attorney, Agent, or Firm*—Jeffers, Hoffman & Niewyk

[57] ABSTRACT

A lamp assembly for a clothes dryer for illuminating the interior of the dryer drum. The lamp socket assembly includes a pivotable socket whereby the assembly may be serviced by first pivoting the socket so that the lightbulb installed in the socket extends into the dryer drum. Positive stop and detent means are provided for positively indicating the operating and service positions of the lamp assembly. Furthermore, a handle is provided to pivot the lamp socket and the handle interferes with the installation of a protective lens for the assembly when the lightbulb has not been fully retracted to the operating position. The bracket for mounting the lamp assembly is formed integrally with reflectors for reflecting the light from the lightbulb into the dryer drum.

20 Claims, 2 Drawing Sheets

DRYER DRUM LAMP ASSEMBLY

BACKGROUND OF THE INVENTION

This invention relates to a lamp assembly for a domestic clothes dryer for mounting a lamp outside the dryer drum to illuminate the interior of the drum. More particularly, this invention relates to a lamp assembly for illuminating the interior of a clothes dryer drum wherein the assembly includes a pivoting lamp socket so that the assembly may be conveniently serviced for replacement of burned out lightbulbs.

The prior art has provided lamp assemblies for clothes dryers. Such lamp assemblies have conventionally been installed at the back of a dryer drum. Prior art lamp assemblies were difficult to service because, after removal of a protective lens, the lamp socket was so oriented that the lightbulb was difficult to reach and rotate for removal from the lamp socket. This problem was made worse because the lamp assembly, in many clothes dryers, could be serviced only by reaching through the dryer drum. Additionally, since it is well known that the threads of lightbulb bases tend to gall because of the use of soft metal for the bases, it was often necessary to apply a relatively large twisting force to the lightbulb. It was then possible to break the lightbulb, thus making it more difficult for the operator to remove the lightbulb base from the lamp socket.

To provide better access to lamp assemblies other prior art lamp assemblies for clothes dryers were so mounted in back of the drum that servicing could be accomplished from the back of the dryer. Since space is limited in many clothes dryers installations, it is often difficult to reach the back of the dryer for replacement of burned out lightbulbs.

Thus it is desired to provide a lamp assembly for a domestic clothes dryer which is conveniently located and which is easy to service.

Pivoting lamp socket assemblies for various applications have also been provided in the prior art. However, problems have been encountered with such fixtures in that they are relatively difficult to service for replacement of lightbulbs, that no positive stops have been provided for the servicing and operating positions of the lamp socket, and that protective lenses for the fixtures could be damaged because, in the operating position, the lamp socket was not completely repositioned so that the lightbulb could touch the lens and the heat developed by the lightbulb could damage the lens. Finally, prior art fixtures have been relatively expensive to manufacture.

It is therefore desired to provide a lamp assembly for a clothes dryer which is relatively inexpensive to manufacture and which is convenient to service for replacement of burned out lightbulbs.

SUMMARY OF THE INVENTION

The present invention overcomes the disadvantages of the above described prior art lamp socket assemblies for clothes dryers by providing an improved lamp assembly therefor.

The lamp socket assembly of the present invention, in one form thereof, provides a pivoting lamp socket which may be serviced for replacement of the lightbulb from inside the clothes dryer drum. Upon removal of a protective lens behind which the lightbulb is mounted, the lamp socket may be pivoted by a handle into the interior of the drum. In the servicing position of the lamp socket, a stablizing foot engages with the wall of the dryer cabinet to support the assembly. After the lightbulb has been serviced, it may be pivoted back to its operating position outside of the drum. An interference tab is provided at the end of the handle to interfere with the installation of the lens if the assembly is not fully repositioned into its operating position. Thus, contact between the lightbulb and the lens is prevented. Furthermore, a positive stop is provided for the lamp socket in the operating position. Additionally, a detent is provided for the servicing position whereby the operator can pivot the lightbulb until a positive detent locks the fixture into place.

The lamp assembly according to the present invention has the advantage that it is very simple in construction and convenient to service. By providing the lamp socket with two positions, a servicing position and an operating position, an operator can easily grasp the lightbulb for removal or for installation thereof. Additionally, by the provision of a stabilizing foot for the assembly, lightweight metal may be used for the assembly bracket, thereby providing an inexpensive assembly. Additionally, by providing a positive stop for the assembly in its operating position and a positive detent for the assembly in its servicing position, the operator is assured that the fixture has been adjusted to the desired position. Furthermore, by providing an interference mechanism for the lens, the lightbulb will not contact the lens in the operating position of the lamp socket and the lens will therefore not be burned or warped by the lightbulb.

A further advantage of the present invention is that the reflector for the lamp assembly may be formed integrally with the mounting bracket of the assembly, thus resulting in a low cost fixture.

The present invention, in one form thereof, comprises a lamp assembly for use in a clothes dryer. The clothes dryer includes a rotatable drum and a cabinet for housing the drum. One wall of the cabinet includes an aperture. A cover is provided to cover the aperture. The lamp assembly comprises a lamp socket and a bracket for pivotably supporting the lamp socket. The bracket may be secured to the cabinet so that the lamp socket may be pivoted to a servicing position in which a lightbulb installed in the socket extends through the aperture. The lamp socket may also be pivoted to an operating position away from the aperture wherein the light bulb illuminates the interior of the drum. An interference tab is connected to the lamp socket to permit the installation of the cover over the aperture only if the lamp socket is in the operating position.

The present invention, in one form thereof, further comprises a lamp assembly for use in a clothes dryer. The clothes dryer has a rotatable drum and a cabinet for housing the drum. A wall of the cabinet includes an aperture for cooperating with the lamp assembly. The cabinet further includes a cover for covering the aperture. The lamp assembly comprises a lamp socket for receiving a lightbulb. A bracket is provided for pivotably supporting the lamp socket. The bracket includes means for securing the bracket to the cabinet. The lamp socket may be pivoted from a servicing position wherein the lightbulb installed in the lamp socket extends through the aperture to an operating position wherein the lightbulb installed in the lamp socket illuminates the interior of the drum. An interference means is connected to the lamp socket for permitting the installation of the cover only if the lamp socket is in the operating position. A stop is connected to the lamp socket for cooperating with the cabinet to define the operating position.

The present invention, in one form thereof, still further comprises a lamp assembly for use in a clothes dryer. The clothes dryer includes an outer cabinet, a drum rotatably mounted in the cabinet, a stationary wall at least partially enclosing an end of the drum, and an aperture in the stationary wall. The lamp assembly may be mounted outside of the drum and adjacent to the aperture to receive a lightbulb for illuminating the interior of the drum. A removable lens for covering the aperture is provided. The lens focuses light from the lightbulb through the aperture into the interior of the drum. The lamp assembly comprises a first body member which is mountable on the dryer. A second body member is pivotably attached to the first body member. A lamp socket is attached to the second body member for receiving the lightbulb and for electrically connecting the lightbulb to an electrical power source. A handle extends from the second body member to pivot the lamp socket from a first position wherein the lightbulb is positioned outside of the drum to a second position wherein the lightbulb is positioned inside the drum. A stop extends through the second body member for contacting the outer cabinet to define the first position of the lamp socket. An interference device extends from the second body member to prevent the lightbulb from contacting the lens in the first position of the lamp socket.

It is an object of the present invention to provide an inexpensive, simple, and useful lamp assembly for a clothes dryer drum whereby servicing of the lightbulb may be conveniently accomplished.

A further object of the invention is to provide such a lamp assembly which may be serviced from inside the drum and wherein positive stops for the servicing and operating positions of the assembly are provided.

Lastly, it is an object of the present invention to provide such a lamp assembly which is inexpensively formed of light weight metal stampings.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
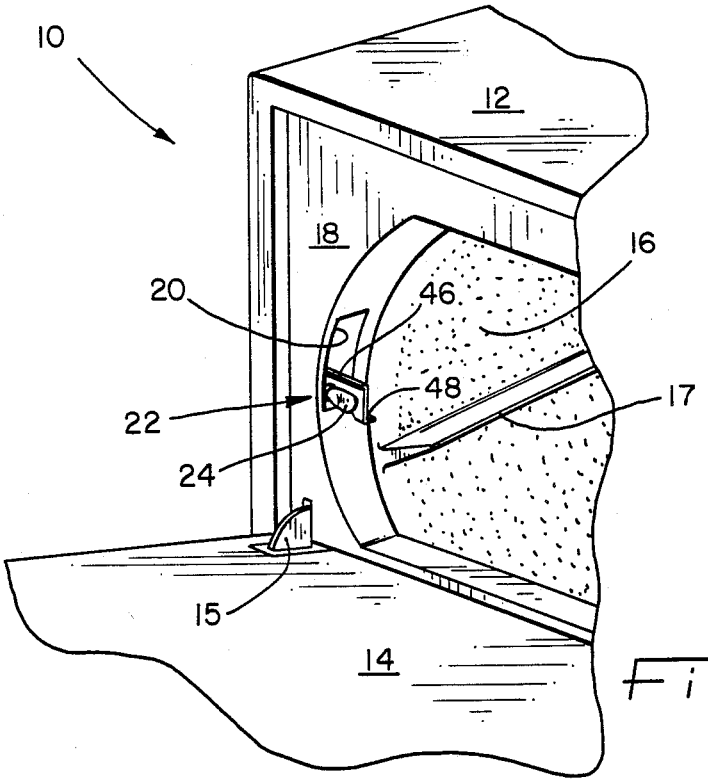
FIG. 1 is a partial perspective front view of a clothes dryer with the door in the open position and the lamp socket of the instant invention in the servicing position.

Referring to FIG. 1, there is shown a clothes dryer 10 including a cabinet 12 having a door 14 pivotably mounted to cabinet 12 by means of two hinges 15 (only one shown). A drum 16 is rotatably mounted in the clothes dryer and includes a baffle 17 for rotating a load of clothes in a drying process as well known in the prior art. A stationary wall 18 of the cabinet includes an aperture 20 for cooperating with a lamp assembly. A lamp assembly 22 is mounted to wall 18. In FIG. 1, the lamp assembly has been pivoted into a servicing position whereby the lightbulb 24 extends through aperture 20 so that the lightbulb may be removed and replaced, if necessary. A handle 26 is provided for pivoting the lamp socket.

Figure 2:
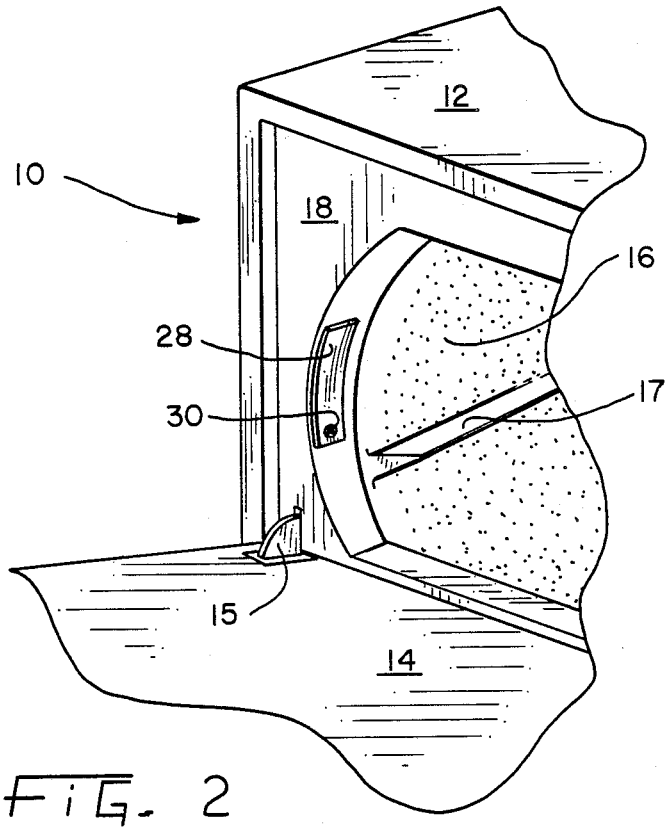
FIG. 2 is a partial perspective front view of the clothes dryer of FIG. 1 with the dryer door open with the lamp socket in the operating position and with the lens installed.

Referring now to FIG. 2, it can be seen that the lamp socket has been pivoted into the operating position whereby lightbulb 24 no longer extends through aperture 20. Instead a suitable cover or lens 28 covers aperture 20 and is secured in place by means of a fastener 30.

Figure 3:
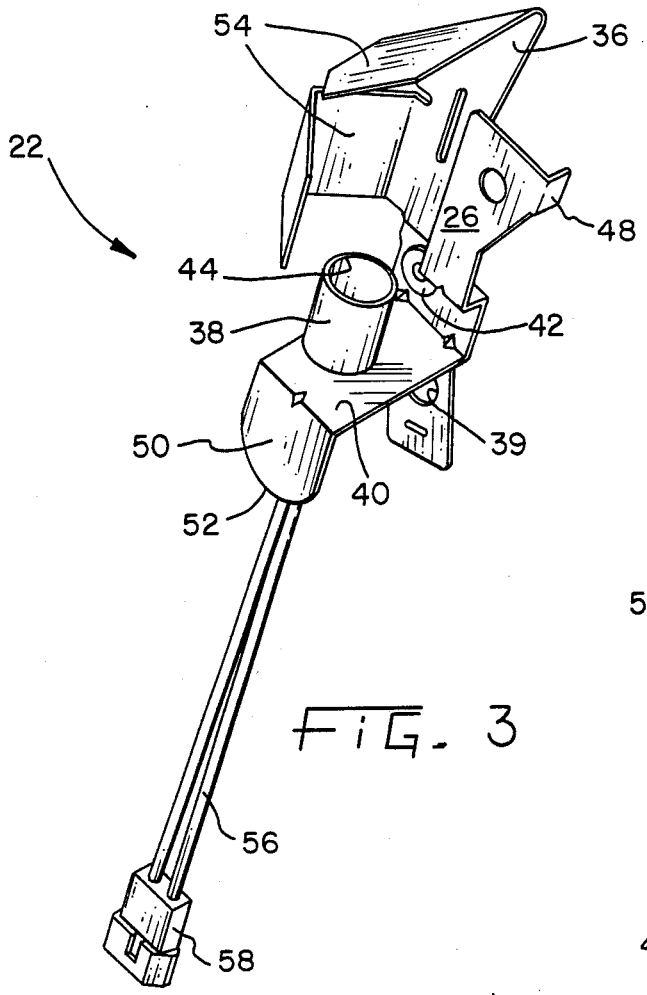
FIG. 3 is a perspective view of the lamp socket assembly according to the present invention.
Figure 4:
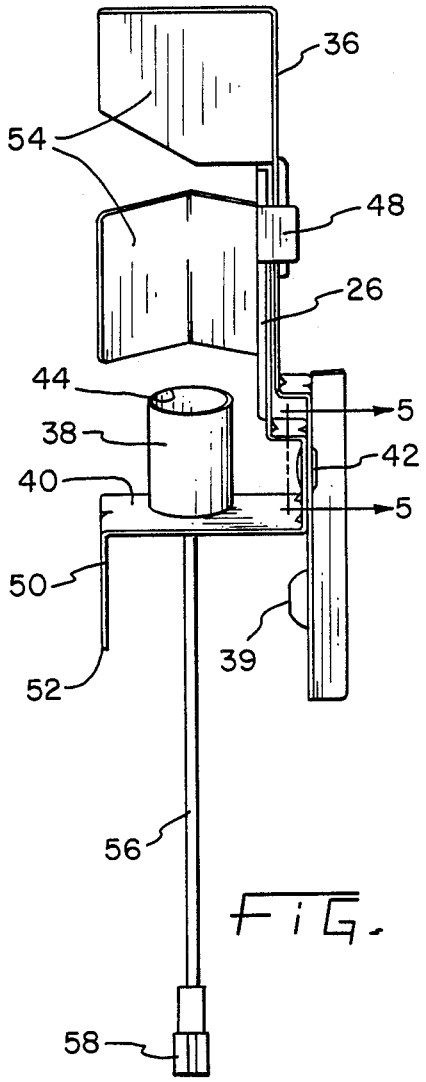
FIG. 4 is a front elevational view of the lamp socket assembly of FIG. 3.

Referring now to FIGS. 3 and 4, the lamp assembly includes a bracket 36 to which is pivotably secured a lamp socket 38 by means of a base 40 which is connected to bracket 36 by means of a rivet 42 or some other suitable connector which permits pivoting of base 40 with respect to bracket 36. Bracket 36 is secured to wall 18 by means of apertures 39 and suitable fasteners (not shown), such as threaded fasteners. Lamp socket 38 includes threads (not shown) on the inside of aperture 44 as is conventional for threadedly receiving the base of an incandescent lightbulb 24. Handle 26 is connected to base 40 for manually pivoting or tilting the lamp socket into either the operating or the servicing position. The operating position of the lamp socket is shown in FIGS. 3 and 4 wherein the lightbulb has been pivoted to a recessed operating position behind aperture 20 of clothes dryer wall 18. In this position, the lightbulb 24 installed in socket 38 will illuminate the interior of dryer drum 16 for the convenience of the user of the clothes dryer. In the servicing position, as shown in FIG. 1, handle 26 is actuated to pivot base 40 and attached socket 38 whereby the lightbulb 24 will extend through aperture 20 and be available to the operator for removal and replacement should that be necessary. Prior to the pivoting of handle 26, lens 28 is removed by the simple removal of a fastener 30.

Handle 26 also includes a tab 48 which is bent at right angles with respect to handle 26. This tab cooperates with wall 18 whereby handle 26 encounters a positive stop as it is tilted counter clockwise as seen in FIG. 3. In the position wherein tab 48 interferes with wall 18, lightbulb 24 is unavailable for service. When handle 26 is pivoted clockwise, lightbulb 24 will extend through aperture 20 whereby it is available for servicing. In that position, a foot 50 has one edge 52 thereof abutting against a wall (not shown) of cabinet 12. In this abutting position of foot 50, pressure placed on socket 38 or base 40 will be supported by foot 50. By means of this arrangement, light gauge metal may be used to form not only base 40 but also bracket 36 as heavy gauge metal will not be necessary to support servicing of the lamp socket assembly.

Figure 5:
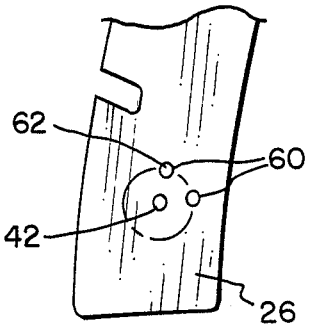
FIG. 5 is a sectional view taken along line 5—5 of FIG. 4.

As shown in FIG. 5, base 40 also includes a detent aperture 60 which cooperates with the projection 62 on bracket 36 to provide a positive detent in the servicing position of socket 38. Thus, for servicing, handle 26 is moved clockwise until the detent 60 snaps in place. Handle 26 and tab 48, in the operating position of the lamp socket assembly, should be fully retracted. If handle 26 and tab 48 are not fully retracted, lens 28 cannot be installed because of interference of handle 26 and tab 48 with the lens. Thus contact of the lightbulb 24 with lens 28 is prevented and the entire socket must be retracted fully for lens 28 to be installed.

Bracket 36 includes reflectors 54 which are integrally stamped with bracket 36 and act to reflect light through the lens and into the dryer drum. The surfaces of reflectors 54 are finished with a suitably reflective finish, as is conventional.

A pair of flexible leads 56 and plug 58 serve to connect socket 38 to a source of electrical supply to energize a lamp 24.

What has therefore been provided is an inexpensive lamp assembly whereby the lamp may be easily serviced by pivoting the lamp socket into the dryer drum through an aperture in the dryer wall.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A lamp assembly for use in a clothes dryer, said clothes dryer including a rotatable drum and a cabinet for housing said drum, said cabinet including an aperture in one wall thereof and a cover for said aperture, said lamp assembly comprising:

a lamp socket;

bracket means for pivotably supporting said lamp socket, said bracket adapted to be secured to a said cabinet whereby said lamp socket may be pivoted from a servicing position in which a lightbulb installed in the socket extends through said aperture to an operating position away from said aperture wherein the lightbulb illuminates the interior of a said drum; and interference means connected to said lamp socket for permitting installation of a said cover over said aperture only if said lamp socket is in said operating position.

2. The assembly according to claim 1 including a reflector means connected to said lamp socket for directing light from a lightbulb installed in said socket through a said aperture.

3. The assembly according to claim 1 wherein said bracket means comprises a reflector for directing light from a lightbulb installed in said socket through a said aperture.

4. The assembly according to claim 1 including a handle connected to said lamp socket for pivoting said lamp socket.

5. The assembly according to claim 4 wherein said handle includes a stop means for cooperating with a said cabinet to define said operating position of said lamp socket.

6. The assembly according to claim 1 including a stop means connected to said bracket means adapted to cooperate with a said cabinet for defining said operating position.

7. The assembly according to claim 1 including support means connected to said lamp socket for supporting said lamp socket in said servicing position.

8. The assembly according to claim 1 including detent means connected to said bracket means for defining said servicing position.

9. A lamp assembly for use in a clothes dryer, said clothes dryer having a rotatable drum and a cabinet for housing the drum, a wall of said cabinet including an aperture for cooperating with said lamp assembly and a cover for covering said aperture, said lamp assembly comprising:

a lamp socket for receiving a lightbulb;

a bracket for pivotably supporting said lamp socket, said bracket including means for securing said bracket to a said cabinet whereby said lamp socket may be pivoted from a servicing position in which a lightbulb installed in said lamp socket extends through a said aperture to an operating position wherein a lightbulb installed in said lamp socket illuminates the interior of a said drum;

interference means connected to said lamp socket for permitting installation of a said cover over said aperture only if said lamp socket is in said operating position; and a stop means connected to said lamp socket for cooperating with said cabinet for defining said operating position.

10. The assembly according to claim 9 including reflective means connected to said lamp socket for directing light from a lightbulb disposed in said lamp socket through a said aperture.

11. The assembly according to claim 9 wherein said bracket comprises a reflector for directing light from a lightbulb disposed in said lamp socket through a said aperture.

12. The assembly according to claim 9 including a handle connected to said lamp socket for pivoting said lamp socket.

13. The assembly according to claim 12 wherein said handle includes said stop means.

14. The assembly according to claim 9 including support means connected to said lamp socket for supporting said lamp socket in said servicing position.

15. The assembly according to claim 9 wherein said lamp socket includes detent means for defining said service position.

16. The assembly according to claim 9 wherein said bracket comprises a metal stamping.

17. A lamp assembly for use in a clothes dryer, said clothes dryer including an outer cabinet, a drum rotatably mounted in said cabinet, a stationary wall at least partially enclosing an end of said drum, and an aperture in said stationary wall, said lamp assembly adapted to be mounted outside of said drum and adjacent to said aperture to receive a lightbulb for illuminating the interior of said drum, a removable lens for covering said aperture and for focusing light from said lightbulb through said aperture into the interior of said drum, said lamp socket assembly comprising:

a first body member adapted to be mounted to said dryer;

a second body member pivotably attached to said first body member;

a lamp socket attached to said second body member for receiving a lightbulb and for electrically connecting said lightbulb to an electrical power source;

handle means extending from said second body member for pivoting said lamp socket from a first position wherein a said lightbulb is positioned outside of said drum to a second position wherein a said lightbulb is positioned inside said drum;

stop means extending from said second body member for contacting a said outer cabinet to define said first position of said lamp socket; and interference means extending from said second body member for preventing a said lightbulb from contacting a said lens in said first position of said lamp socket.

18. The lamp socket assembly according to claim 17 including a reflector means attached to said first body member for directing light from said lightbulb through a said aperture.

19. The lamp socket assembly according to claim 18 wherein said reflector means is integrally formed with said first body member for directing light from a said lightbulb through a said aperture.

20. The lamp socket assembly according to claim 17 including first detent means formed in said first body member, and a second detent means formed on said second body member and engagable with said first detent means when said second body member is in said second position.

* * * * *